US010464329B2

(12) United States Patent
Sekiya

(10) Patent No.: US 10,464,329 B2
(45) Date of Patent: Nov. 5, 2019

(54) LIQUID CONTAINER AND LIQUID SUPPLY APPARATUS

(71) Applicant: DISCO CORPORATION, Tokyo (JP)

(72) Inventor: Kazuma Sekiya, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 0 days.

(21) Appl. No.: 16/010,672

(22) Filed: Jun. 18, 2018

(65) Prior Publication Data

US 2018/0361749 A1 Dec. 20, 2018

(30) Foreign Application Priority Data

Jun. 20, 2017 (JP) ..... 2017-120319

(51) Int. Cl.
*B41J 2/175* (2006.01)

(52) U.S. Cl.
CPC ..... *B41J 2/17513* (2013.01); *B41J 2/175* (2013.01); *B41J 2/17553* (2013.01); *B41J 2/17596* (2013.01); *B41J 2002/17516* (2013.01)

(58) Field of Classification Search
CPC .... B41J 2/175; B41J 2/17503; B41J 2/17506; B41J 2/17513; B41J 2/17553; B41J 2/17556; B41J 2002/17516
See application file for complete search history.

(56) References Cited

U.S. PATENT DOCUMENTS 3,414,165 A * 12/1968 Goodenow ..... B65D 25/42 222/572
6,290,343 B1 * 9/2001 Lewis ..... B41J 2/175 347/85
8,408,246 B2 * 4/2013 Adams ..... B01D 19/0005 137/563
2009/0318883 A1 * 12/2009 Sugahara ..... A61F 9/0008 604/298
2010/0060701 A1 * 3/2010 Takada ..... B41J 2/17509 347/86

FOREIGN PATENT DOCUMENTS

JP 2013254817 A 12/2013
JP 2014192473 A 10/2014

* cited by examiner

*Primary Examiner* — Scott A Richmond
(74) *Attorney, Agent, or Firm* — Greer Burns & Crain, Ltd.

(57) ABSTRACT

A liquid container includes an inner bag that is made from a film-shaped member and reserves a liquid therein, and an outer container that accommodates the inner bag therein and has a first opening communicating with a mouth of the inner bag and a second opening for supplying a fluid into a space between the inner bag and an inner wall of the outer container.

19 Claims, 12 Drawing Sheets

LIQUID CONTAINER AND LIQUID SUPPLY APPARATUS

BACKGROUND OF THE INVENTION

Field of the Invention

The present invention relates to a liquid container and a liquid supply apparatus.

Description of the Related Art

Containers for containing various liquids and gases include those for containing a liquid which has been degassed or a liquid which should not be oxidized through contact with air. The liquid which has been degassed or the liquid which should not be oxidized through contact with air is a degassed liquid such as, for example, a liquid resin which is to be applied to a semiconductor wafer to become a liquid protective film (see, for example, Japanese Patent Laid-Open No. 2013-254817) or a liquid resin which is to be applied to a surface on the side opposite to a surface to be ground of a plate-shaped workpiece and cured to become a protective member when grinding the plate-shaped workpiece (see, for example, Japanese Patent Laid-Open No. 2014-192473).

SUMMARY OF THE INVENTION

Each of the liquids described in Japanese Patent Laid-Open No. 2013-254817 and Japanese Patent Laid-Open No. 2014-192473 is stored in a container such as a tank and transported, and the container is mounted to a supply apparatus. If a gas is present in the tank, the liquid may be oxidized, and the gas may mix into the liquid on occurrence of, for example, swinging of the tank during transportation. In view of this, each of the liquids described in Japanese Patent Laid-Open No. 2013-254817 and Japanese Patent Laid-Open No. 2014-192473 may be contained in a container in the state of having been degassed and filling up the container.

However, when each of the liquids described in Japanese Patent Laid-Open No. 2013-254817 and Japanese Patent Laid-Open No. 2014-192473 is contained in a container in the state of having been degassed and filling up the container, it is necessary to draw a gas from the exterior at the time of discharging the liquid from the container, so that, again, it is necessary to supply a gas from the exterior into the container. Therefore, each of the liquids described in Japanese Patent Laid-Open No. 2013-254817 and Japanese Patent Laid-Open No. 2014-192473 has the problem that in the case where it takes a long time for the liquid in the container to be used up, the liquid is contained in the container together with a gas for a prolonged time, and the gas may mix into the liquid, triggered by some cause.

Accordingly, it is an object of the present invention to provide a liquid container and a liquid supply apparatus by which mixing of a gas into a contained liquid can be restrained.

In accordance with an aspect of the present invention, there is provided a liquid container including: an inner bag that is made from a film-shaped member and reserves a liquid therein; and an outer container that accommodates the inner bag therein and includes a first opening communicating with a mouth of the inner bag and a second opening for supplying a fluid into a space between the inner bag and an inner wall of the outer container. The inner bag with the liquid reserved therein is deformed by supplying the fluid, to thereby feed out the liquid from the inner bag to an outside.

In the liquid container, the inner bag accommodated in the outer container may be in close contact with the liquid, and a check valve for preventing returning of the liquid to be fed out may be provided at the mouth of the inner bag.

In the liquid container, the outer container may have a third opening for discharging the fluid from the space.

In accordance with another aspect of the present invention, there is provided a liquid supply apparatus configured to supply a liquid to a destination by use of the above-mentioned liquid container, the liquid supply apparatus including: a feed-out passage for feeding out the liquid from the inner bag to the destination through the first opening; a fluid supply passage for supplying the fluid into the space in the outer container through the second opening; and a fluid control section that is disposed in the fluid supply passage and is configured to control supply of the fluid from a fluid supply source. When feeding out the liquid, the fluid is supplied into the space in the outer container, to press and deform the inner bag reserving the liquid therein.

The liquid supply apparatus may further include a gas supply passage for supplying a gas into the inner bag, and a gas control section configured to control supply of the gas from a gas supply source, and before the liquid container from which the liquid has been discharged is detached from the liquid supply apparatus, the inner bag may be inflated by supplying the gas to discharge the fluid collecting in the space in the outer container, thereby reducing weight of the liquid container.

In the liquid supply apparatus, the fluid may be a liquid.

The present invention has an effect that mixing of a gas into a contained liquid can be restrained.

The above and other objects, features and advantages of the present invention and the manner of realizing them will become more apparent, and the invention itself will best be understood from a study of the following description and appended claims with reference to the attached drawings showing preferred embodiments of the invention.

DETAILED DESCRIPTION OF THE PREFERRED EMBODIMENTS

Modes for carrying out the present invention (embodiments) will be described in detail below with reference to the attached drawings. The present invention is not to be limited by the description of the following embodiments. In addition, the constituent elements described below include those easily conceivable by persons skilled in the art and substantial equivalence thereof. Further, the configurations described below can be combined as required. Besides, various omissions, replacements and modifications are possible without departing from the gist of the present invention.

Embodiment 1

Figure 1:
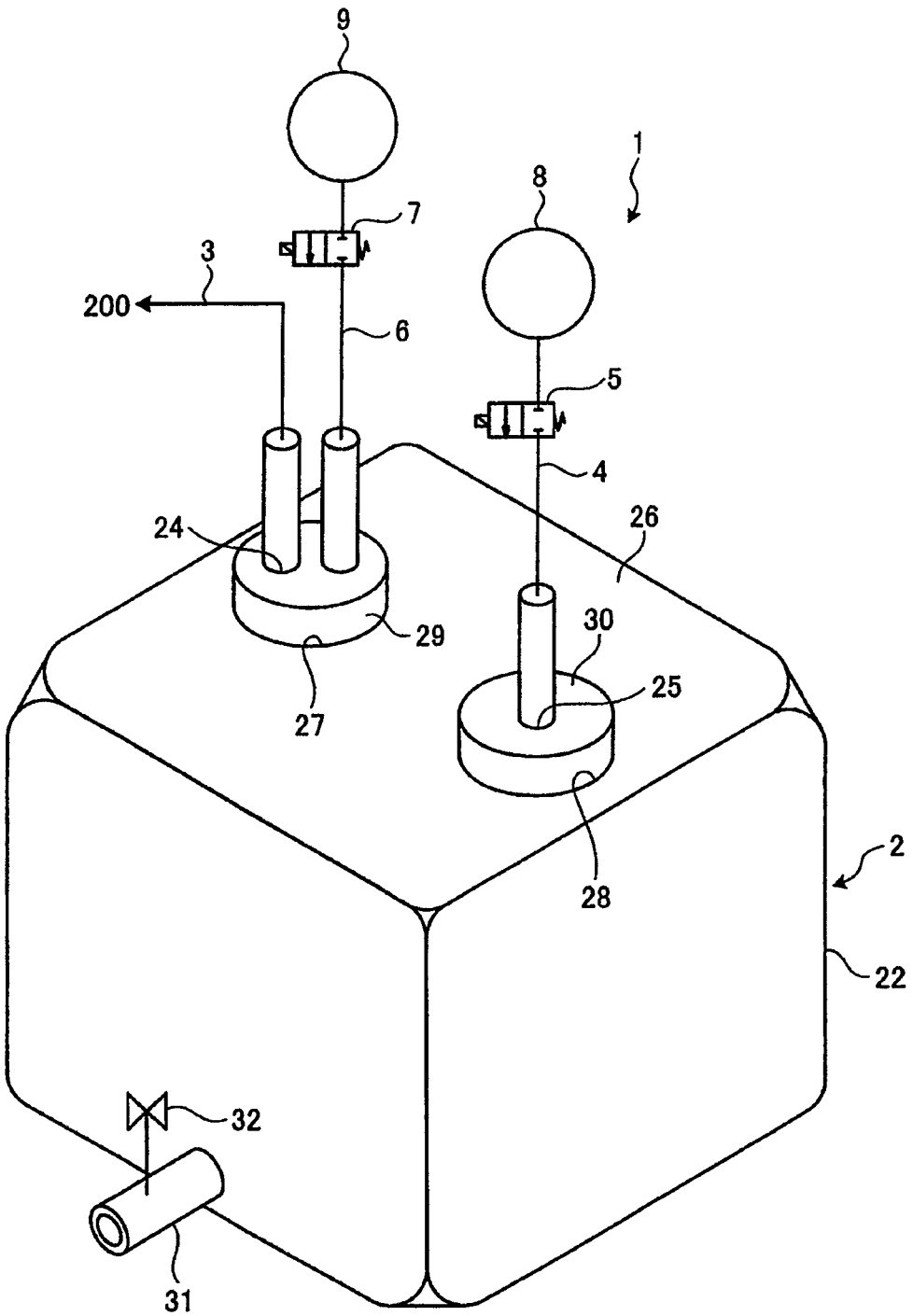
FIG. 1 is a perspective view depicting a configuration example of a liquid supply apparatus according to Embodiment 1.
Figure 2:
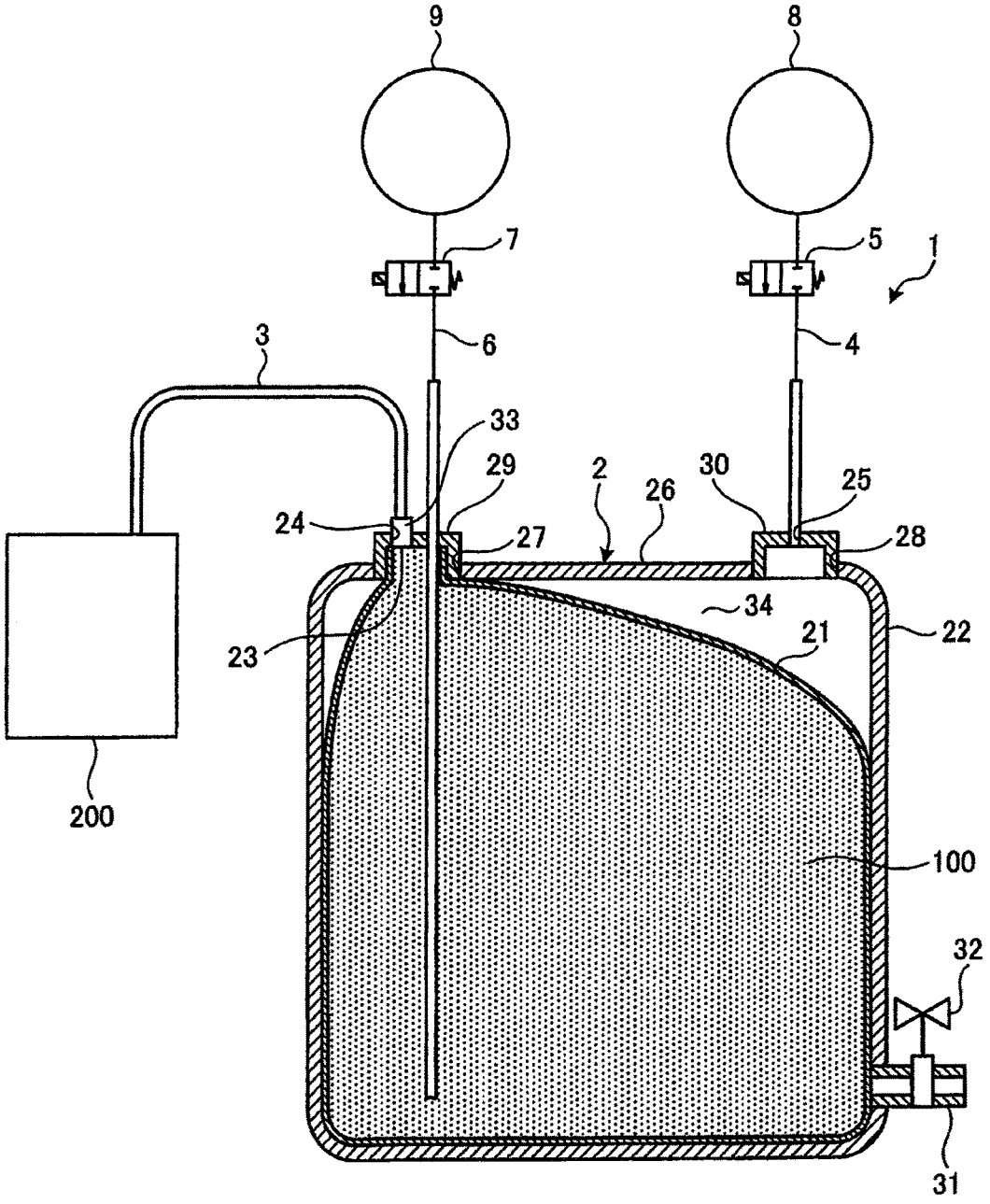
FIG. 2 is a sectional view of an essential part of the liquid supply apparatus depicted in FIG. 1.

A liquid container and a liquid supply apparatus according to Embodiment 1 of the present invention will be described based on the drawings. FIG. 1 is a perspective view depicting a configuration example of a liquid supply apparatus according to Embodiment 1. FIG. 2 is a sectional view of an essential part of the liquid supply apparatus depicted in FIG. 1.

As depicted in FIGS. 1 and 2, the liquid supply apparatus 1 according to Embodiment 1 includes a liquid container 2 that reserves a liquid 100 (depicted in only FIG. 2) therein, a feed-out passage 3, a fluid supply passage 4, a fluid control section 5, a gas supply passage 6, and a gas control section 7. The liquid supply apparatus 1 is an apparatus for supplying the liquid 100 to a destination 200 by use of the liquid container 2. Note that the liquid 100 is, for example, a water-soluble liquid resin for constituting a protective film for restraining adhesion of debris to devices of a wafer when subjecting the wafer to laser ablation processing, or an ultraviolet (UV)-curing liquid resin constituting a protective member for protecting a surface of a workpiece when grinding the workpiece, but the liquid 100 is not limited to these. The water-soluble liquid resin includes polyvinyl alcohol (PVA) or polyvinylpyrrolidone (PVP) or the like. In addition, the destination 200 is a laser processing apparatus for laser ablation processing of a wafer in the case where the liquid 100 is a water-soluble liquid resin, or the destination 200 is an adhering apparatus for adhering a liquid resin to the workpiece in the case where the liquid 100 is a UV-curing liquid resin, but the destination 200 is not limited to these.

As depicted in FIG. 2, the liquid container 2 is a double-structure container having an inner bag 21 and an outer container 22. The inner bag 21 reserves the liquid 100 therein. The inner bag 21 is made from a flexible film-shaped member, and its inside is sealed exclusive of a mouth 23 for discharging the liquid 100. The liquid 100 contained in the inner bag 21 has been degassed, and an inner surface of the inner bag 21 is in close contact with the liquid 100. In the state of being filled up with the liquid 100, the inner bag 21 is in close contact with the inner surface of the outer container 22.

The outer container 22 is a container made from a rigid material. For example, the outer container 22 is a plastic tank (polyethylene-made tank) or an eighteen liter drum (metal-made tank), but is not limited to these. The outer container 22 accommodates the inner bag 21 therein, and has a first opening 24 communicating with the mouth 23 of the inner bag 21 and a second opening 25 for supplying a fluid 300 (depicted in FIG. 3) into a space 34 between the inner bag 21 and an inner wall of the outer container 22. The first opening 24 and the second opening 25 are provided in caps 29 and 30 which are attached to holes 27 and 28, respectively, penetrating a wall 26 located on the upper side of the outer container 22. Note that in Embodiment 1, the fluid 300 is pure water, which is a liquid, but the fluid 300 is not limited to pure water and may be a gas.

In addition, the outer container 22 has a discharge pipe 31 as a third opening for discharging the fluid 300 from the space 34. The discharge pipe 31 is a pipe providing communication between the space 34 and the exterior of the outer container 22, and is provided at a lower end portion of the outer container 22. The discharge pipe 31 is equipped with an on-off valve 32 for opening and closing the passage inside the discharge pipe 31.

The liquid container 2 is equipped with a check valve 33. The check valve 33 is provided at the mouth 23 of the inner bag 21 in the state of being attached to the mouth 23 of the inner bag 21 and disposed in the first opening 24. Thus, the mouth 23 of the inner bag 21 is equipped with the check valve 33. The check valve 33 permits the liquid 100 to be discharged from the inner bag 21 to the destination 200 through the mouth 23, and prevents (or restricts) the liquid 100 to be discharged to the destination 200 from returning to the inner bag 21 side.

The feed-out passage 3 is a passage for the liquid 100, for feeding out the liquid 100 from the inner bag 21 to the destination 200 through the check valve 33 disposed in the first opening 24. The feed-out passage 3 interconnects the check valve 33 and the destination 200.

The fluid supply passage 4 is a passage for the fluid 300, for supplying the fluid 300 into the space 34 in the outer container 22 through the second opening 25. The fluid supply passage 4 interconnects the second opening 25 and a fluid supply source 8.

The fluid control section 5 is disposed in the fluid supply passage 4, for controlling the supply of the fluid 300 from the fluid supply source 8. In Embodiment 1, the fluid control section 5 is an on-off valve provided in the fluid supply passage 4, for opening and closing the passage in the fluid supply passage 4. In the present invention, however, the fluid control section 5 is not limited to the on-off valve, and may be, for example, a pump for feeding out the fluid 300 from the fluid supply source 8 into the space 34 in the outer container 22.

The gas supply passage 6 is a passage for a gas, which penetrates the cap 29, has one end opening into the inner bag 21, and is for supplying a gas 400 (depicted in FIG. 5) into the inner bag 21. The gas supply passage 6 interconnects the inner bag 21 and a gas supply source 9.

The gas control section 7 is disposed in the gas supply passage 6, for controlling the supply of the gas 400 from the gas supply source 9. In Embodiment 1, the gas control section 7 is an on-off valve provided in the gas supply passage 6, for opening and closing the passage in the gas supply passage 6. In the present invention, however, the gas control section 7 is not limited to the on-off valve, and may be, for example, a pump for feeding out the gas 400 from the gas supply source 9 into the inner bag 21.

In the liquid supply apparatus 1 and the liquid container 2 configured as aforementioned, when feeding out the liquid 100, the fluid 300 from the fluid supply passage 4 is supplied into the space 34 in the outer container 22, to deform the inner bag 21 reserving the liquid 100 therein by the supply of the fluid 300, or by pressing by the fluid 300, whereby the liquid 100 is supplied through the mouth 23 of the inner bag 21 and through the check valve 33 and the feed-out passage 3 to the destination 200 outside the outer container 22.

Figure 3:
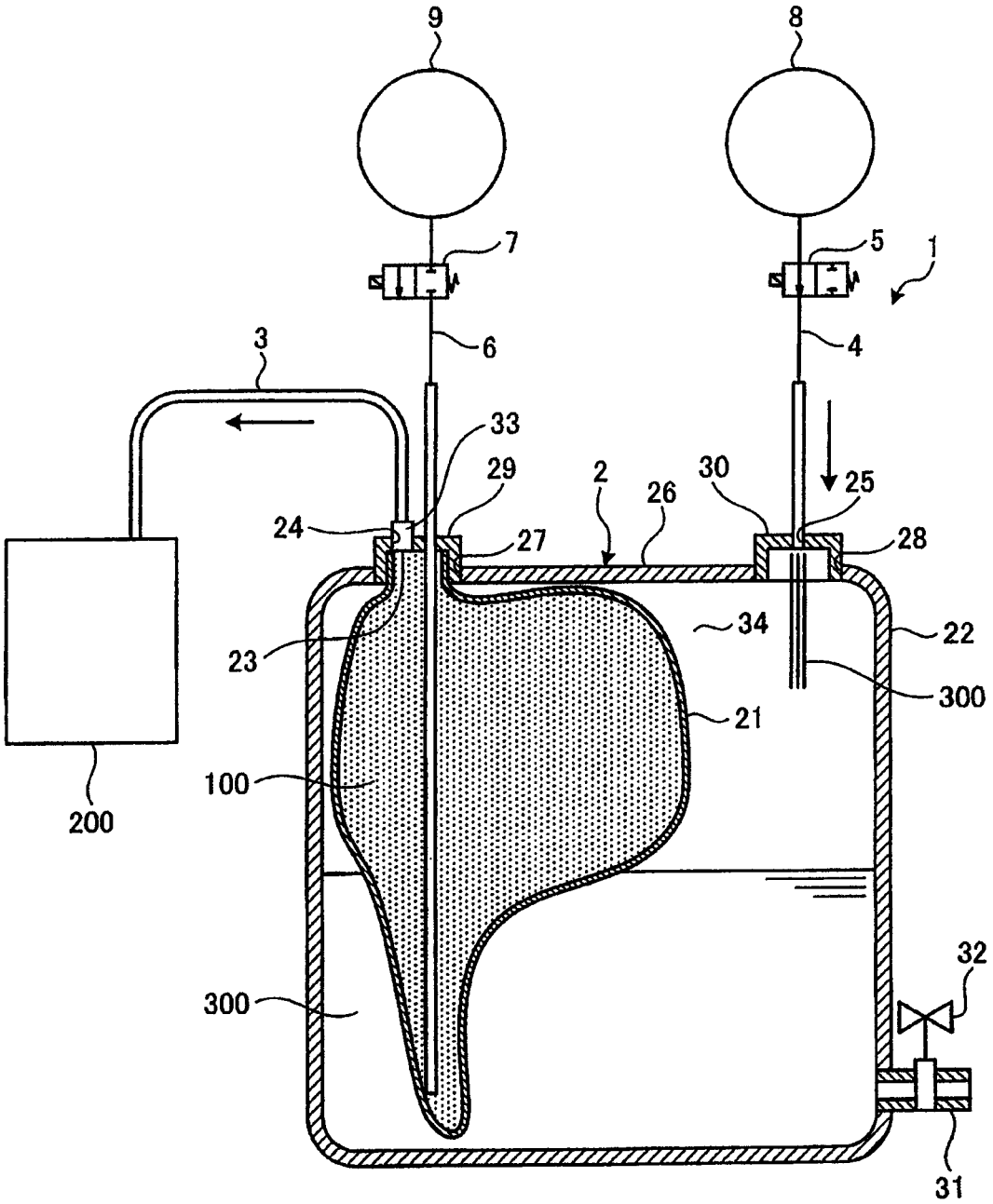
FIG. 3 is a sectional view of an essential part, depicting the liquid supply apparatus and a liquid container according to Embodiment 1 during feeding-out of a liquid.
Figure 4:
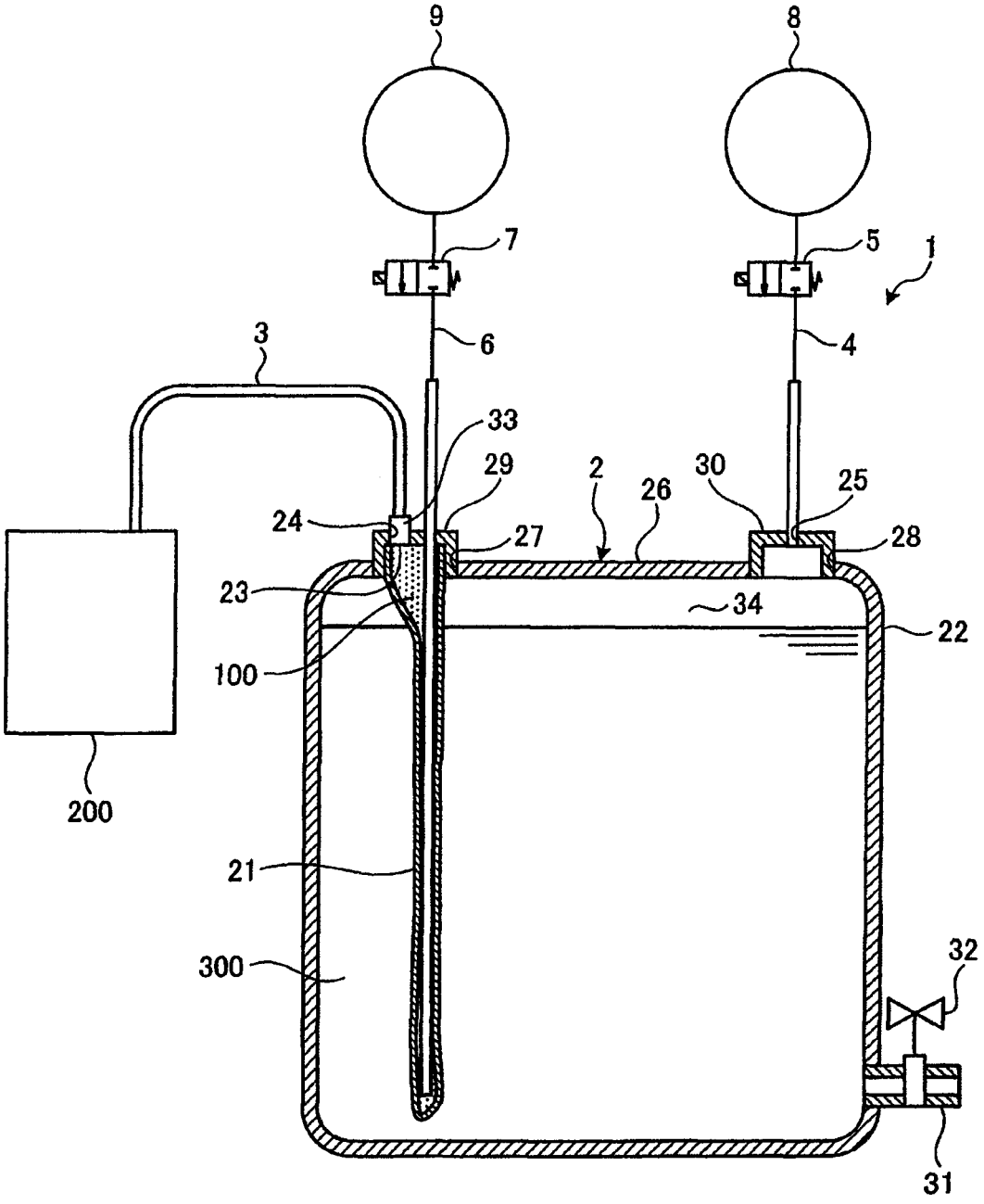
FIG. 4 is a sectional view of an essential part, depicting the liquid supply apparatus and the liquid container according to Embodiment 1 when feeding-out of the liquid is completed.

Now, an operation of the liquid supply apparatus 1 and the liquid container 2 according to Embodiment 1 to supply the liquid 100 to the destination 200 will be described below. FIG. 3 is a sectional view of an essential part, depicting the liquid supply apparatus and the liquid container according to Embodiment 1 during feeding-out of the liquid. FIG. 4 is a sectional view of an essential part, depicting the liquid supply apparatus and the liquid container according to Embodiment 1 when the feeding-out of the liquid is completed.

In the liquid supply apparatus 1 and the liquid container 2 according to Embodiment 1, when supplying the liquid 100 to the destination 200, first, the on-off valve 32 is closed, and the gas control section 7 closes the passage in the gas supply passage 6. Then, in the liquid supply apparatus 1 and the liquid container 2, the fluid control section 5 opens the passage in the fluid supply passage 4, whereby the fluid 300 in the fluid supply source 8 is supplied into the space 34. As the amount of the fluid 300 supplied into the space 34 increases, the fluid 300 presses the inner bag 21 to deform the inner bag 21 in a contracting manner, as depicted in FIG. 3. In the liquid supply apparatus 1 and the liquid container 2, the fluid 300 in the space 34 presses the inner bag 21 to contract the inner bag 21, whereby the liquid 100 in the inner bag 21 is supplied through the mouth 23, the check valve 33 and the feed-out passage 3 to the destination 200. In the liquid supply apparatus 1 and the liquid container 2, when the feeding-out of the liquid 100 in the inner bag 21 is completed, the space 34 in the outer container 22 is substantially filled up with the fluid 300, as depicted in FIG. 4; in this instance, since the check valve 33 is attached to the mouth 23 of the inner bag 21, the inner bag 21 makes close contact with the gas supply passage 6.

Figure 5:
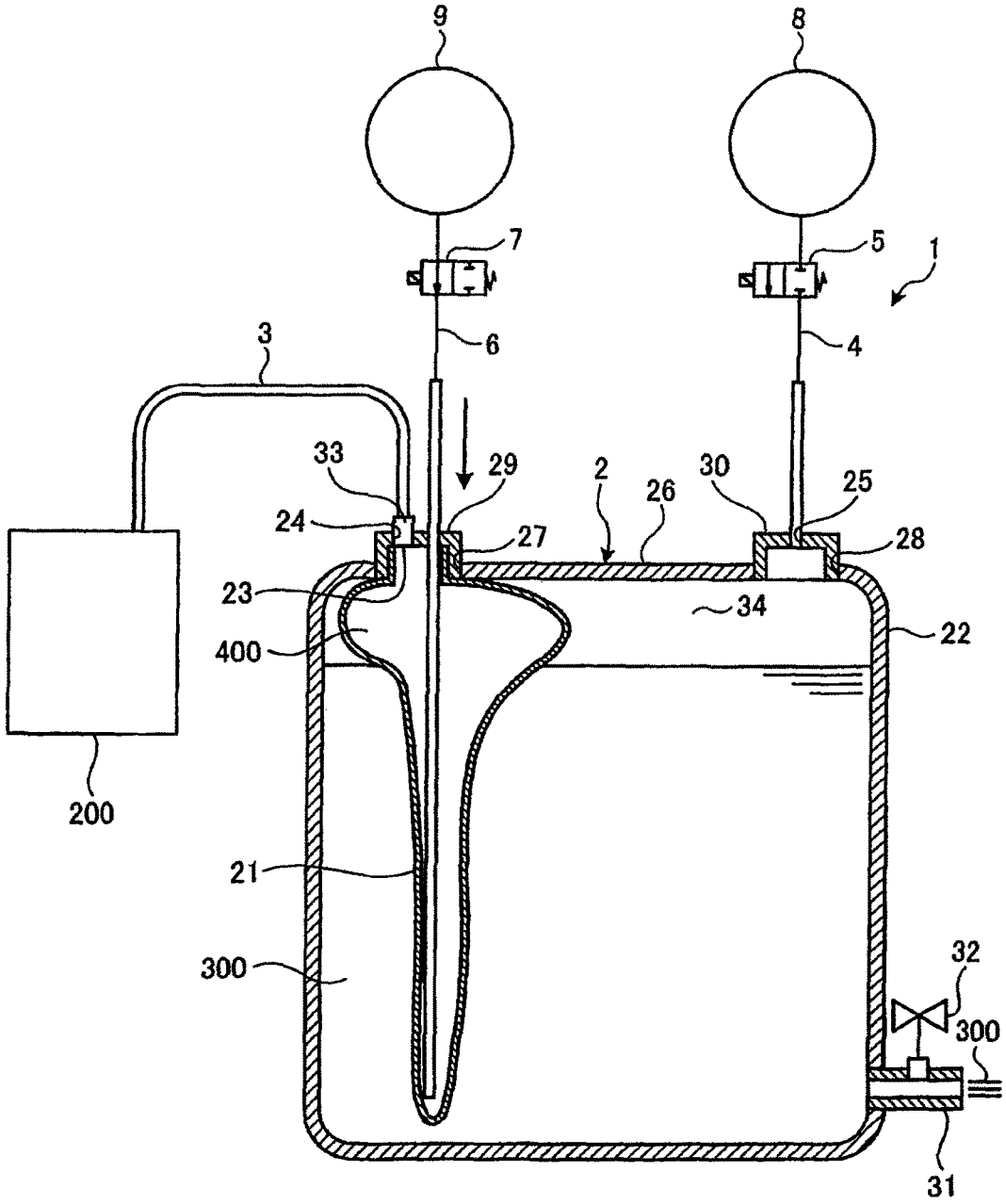
FIG. 5 is a sectional view of an essential part, depicting the liquid supply apparatus and the liquid container according to Embodiment 1 during feeding-out of the fluid.
Figure 6:
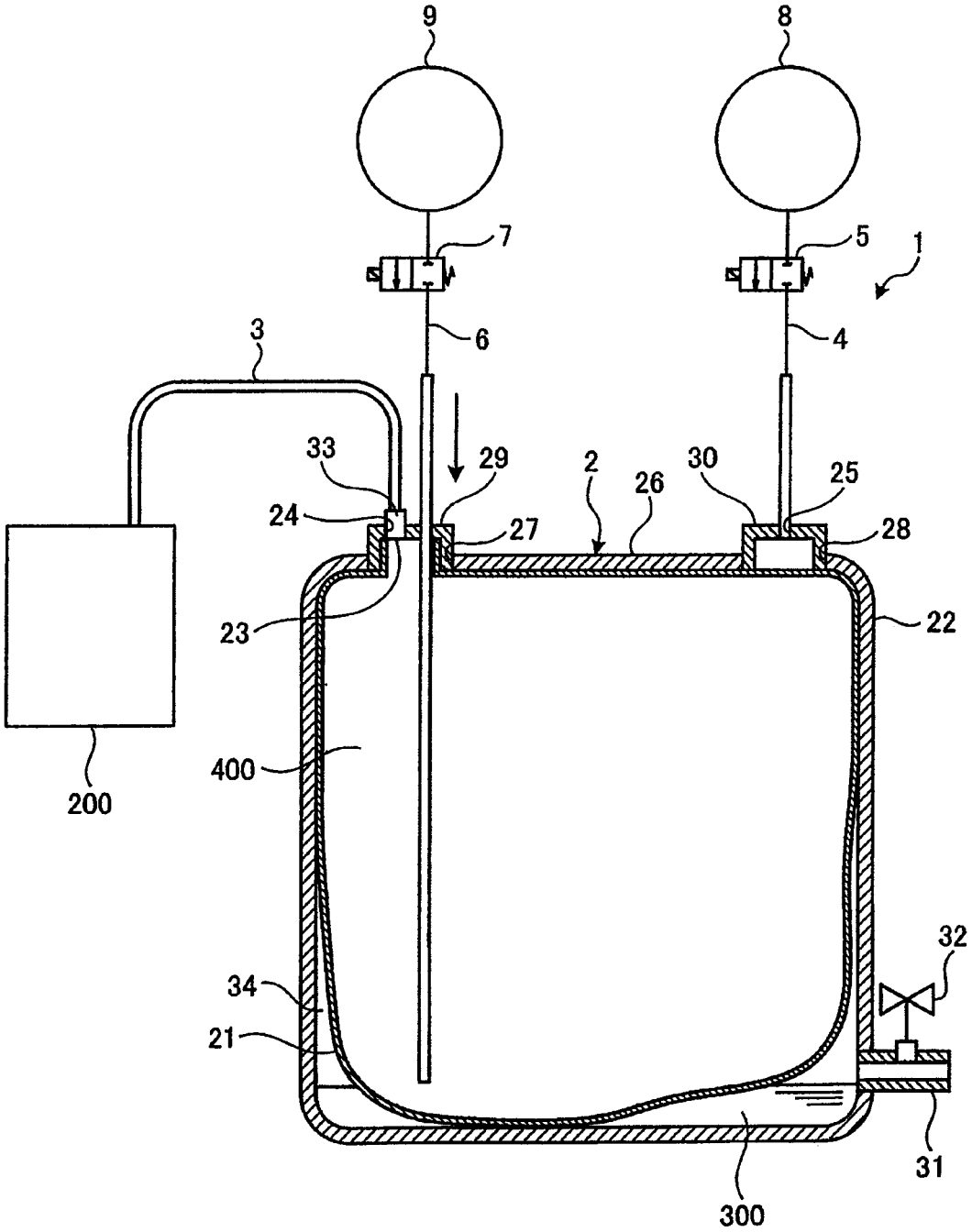
FIG. 6 is a sectional view of an essential part, depicting the liquid supply apparatus and the liquid container according to Embodiment 1 when feeding-out of the fluid is completed.

Now, an operation of discharging the fluid 300 collecting in the space 34 of the outer container 22 before the liquid container 2 from which the liquid 100 has been discharged is detached from the liquid supply apparatus 1 will be described based on the drawings. FIG. 5 is a sectional view of an essential part, depicting the liquid supply apparatus and the liquid container according to Embodiment 1 during the feeding-out of the fluid. FIG. 6 is a sectional view of an essential part, depicting the liquid supply apparatus and the liquid container according to Embodiment 1 when the feeding-out of the fluid is completed.

In the liquid supply apparatus 1 and the liquid container 2 according to Embodiment 1, when the fluid 300 in the space 34 in the outer container 22 is discharged to the outside of the outer container 22, first, the fluid control section 5 closes the passage in the fluid supply passage 4, and the on-off valve 32 is opened. Then, in the liquid supply apparatus 1 and the liquid container 2, the gas control section 7 opens the passage in the gas supply passage 6, to supply the gas 400 in the gas supply source 9 into the inner bag 21 through the gas supply passage 6. As the amount of the gas 400 supplied into the inner bag 21 increases, the inner bag 21 is inflated, as depicted in FIG. 5, the inflated inner bag 21 presses the fluid 300 collecting in the space 34, to discharge the fluid 300 to the exterior of the outer container 22 through the discharge pipe 31, thereby reducing the weight of the liquid container 2. In the liquid supply apparatus 1 and the liquid container 2, when the discharge of the fluid 300 in the space 34 in the outer container 22 is completed, the inner bag 21 makes close contact with the inner surface of the outer container 22, as depicted in FIG. 6, resulting in a state in which the fluid 300 is little left in the space 34 in the outer container 22. The liquid container 2 is detached from the liquid supply apparatus 1 when the fluid 300 in the space 34 in the outer container 22 has been discharged. Note that the fluid 300 discharged from the space 34 is discarded as it is, or is reused after being clarified.

As has been described above, the liquid supply apparatus 1 and the liquid container 2 according to Embodiment 1 include the double-structure container including the inner bag 21 and the outer container 22, and, by supplying the fluid 300 into the space 34 between the inner bag 21 and the outer container 22, the inner bag 21 is pressed and deformed, to feed out the liquid 100. Therefore, in the liquid container 2, even when the feeding-out of the liquid 100 is momentarily stopped, it is possible, by maintaining the fluid 300 in the space 34, to restrain the inner bag 21 from being inflated again, and to restrain a gas from penetrating into the inner bag 21 from the outside. As a result, the liquid container 2 can restrain a gas from mixing into the liquid 100 contained therein.

Since the fluid 300 supplied into the space 34 is a liquid such as pure water, the liquid container 2 can discharge a desired amount of the liquid 100 from the inner bag 21.

In the liquid container 2, in a state in which the liquid 100 is reserved in the inner bag 21, the inner bag 21 is in close contact with the liquid 100. In addition, the check valve 33 is provided at the mouth 23 of the inner bag 21. Therefore, it is possible to restrain an external gas from penetrating into the inner bag 21 during storage or during transportation, and, since the liquid 100 does not make contact with any gas, oxidation of the liquid 100 can be prevented.

Since the liquid container 2 is provided with the discharge pipe 31 for discharging the fluid 300 from the space 34, the fluid 300 can be discharged through the discharge pipe 31 when the feeding-out of the liquid 100 in the inner bag 21 is completed. Therefore, the weight of the liquid container 2 when the liquid container 2 is detached from the liquid supply apparatus 1 can be reduced.

In addition, in the liquid supply apparatus 1, when detaching the liquid container 2 from the liquid supply apparatus 1 after the feeding-out of the liquid 100 out of the inner bag 21 is finished, a gas is supplied into the inner bag 21 to inflate the inner bag 21, whereby the fluid 300 collecting in the space 34 in the outer container 22 is discharged. Therefore, a reduction in the weight of the liquid container 2 when detaching the liquid container 2 can be realized, and the liquid container 2 from which the liquid 100 has been fed out can be easily carried out.

Embodiment 2

Figure 7:
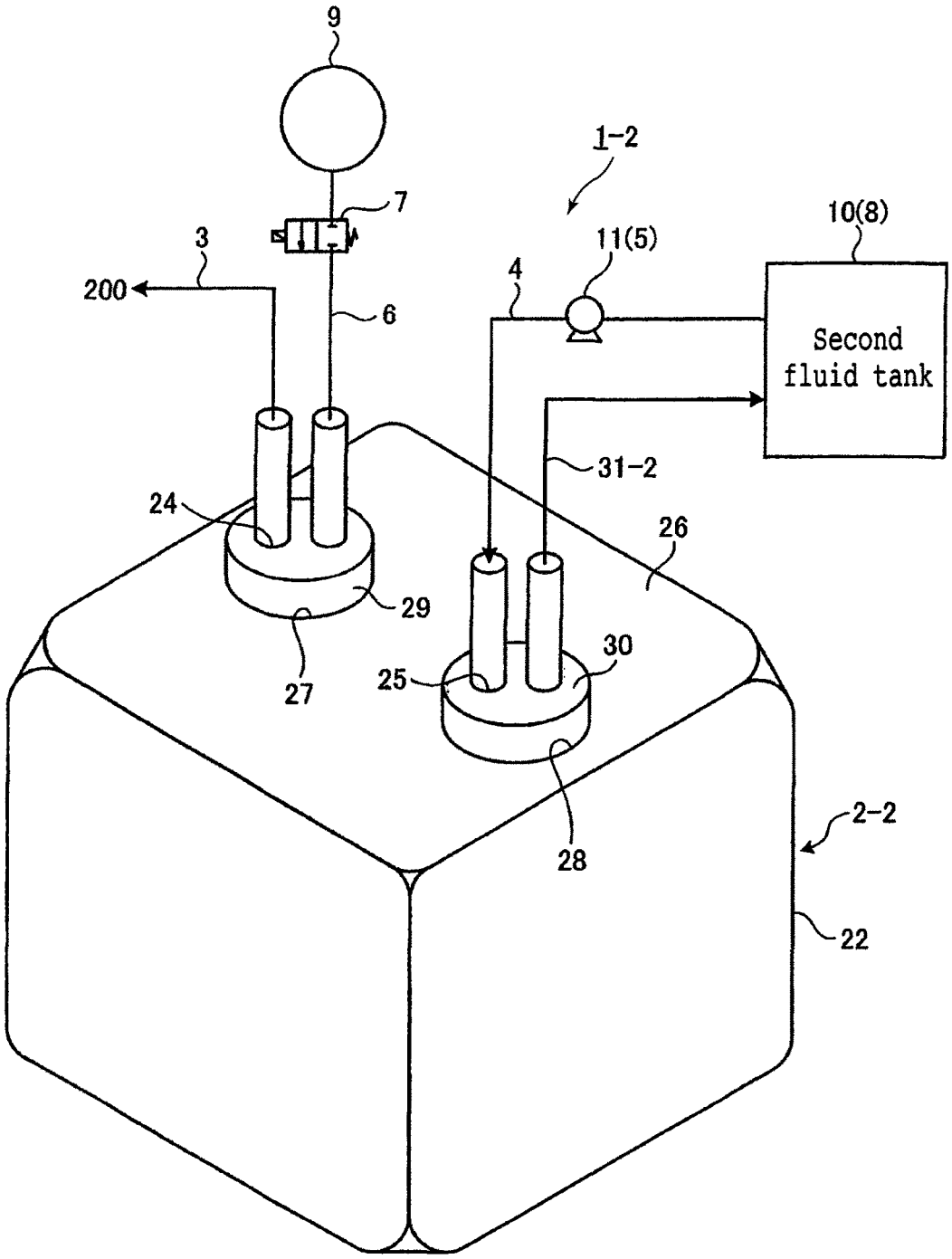
FIG. 7 is a perspective view depicting a configuration example of a liquid supply apparatus according to Embodiment 2.
Figure 8:
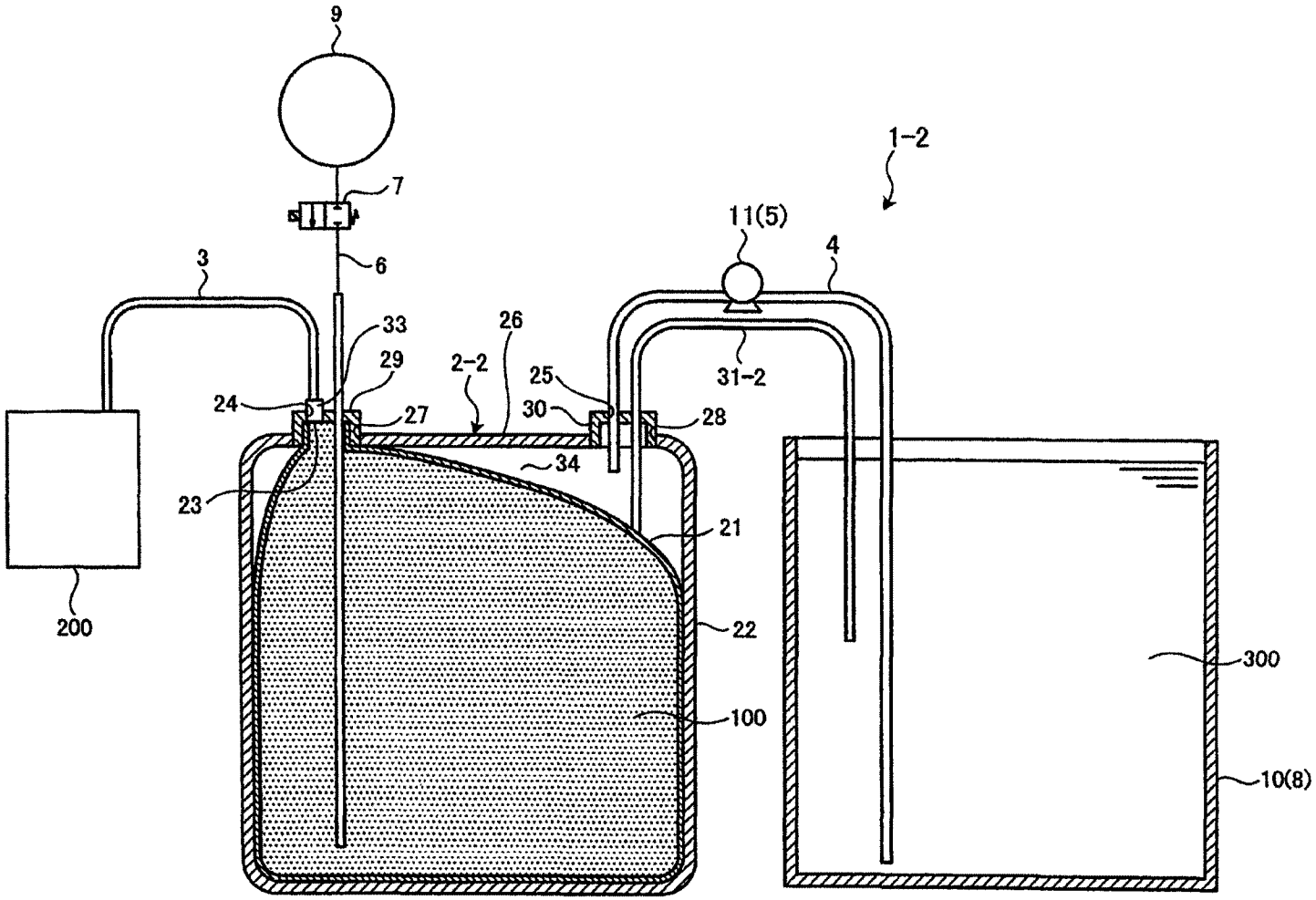
FIG. 8 is a sectional view of an essential part of the liquid supply apparatus depicted in FIG. 7.

A liquid container and a liquid supply apparatus according to Embodiment 2 of the present invention will be described based on the drawings. FIG. 7 is a perspective view depicting a configuration example of the liquid supply apparatus according to Embodiment 2. FIG. 8 is a sectional view of an essential part of the liquid supply apparatus depicted in FIG. 7. In FIGS. 7 and 8, the same parts as those in Embodiment 1 above are denoted by the same reference symbols as used above, and descriptions of them will be omitted.

A liquid supply apparatus 1-2 and a liquid container 2-2 according to Embodiment 2 are configured in the same way as in Embodiment 1, except that as depicted in FIGS. 7 and 8, a fluid supply source 8 is a second fluid tank 10 for reserving a fluid 300, that a discharge pipe 31-2 is not provided in an outer container 22 but penetrates a cap 30 and interconnects a space 34 and the second fluid tank 10, and that a fluid control section 5 is a pump 11 for feeding out the fluid 300 in the second fluid tank 10 into the space 34. In the liquid supply apparatus 1-2 and the liquid container 2-2 according to Embodiment 2, when the fluid 300 in the space 34 in the outer container 22 is discharged, the discharged fluid 300 is returned into the second fluid tank 10 through the discharge pipe 31-2. Note that a fluid supply passage 4 and the discharge pipe 31-2 are provided in Embodiment 2, however, in the present invention a configuration may be adopted such that the discharge pipe 31-2 is not provided, and, when discharging the fluid 300 in the space 34 in the outer container 22, the discharged fluid 300 is returned into the second fluid tank 10 through the fluid supply passage 4.

The liquid supply apparatus 1-2 and the liquid container 2-2 according to Embodiment 2 include a double-structure container including an inner bag 21 and the outer container 22, and, by supplying the fluid 300 into the space 34 between the inner bag 21 and the outer container 22, the inner bag 21 is pressed and deformed, to feed out a liquid 100. Therefore, mixing of a gas into the liquid 100 contained in the inner bag 21 can be restrained.

In addition, in the liquid supply apparatus 1-2 and the liquid container 2-2 according to Embodiment 2, when discharging the fluid 300 in the space 34 in the outer container 22, the discharged fluid 300 is returned into the second fluid tank 10, and, therefore, the amount of the fluid 300 to be used can be suppressed.

Embodiment 3

Figure 9:
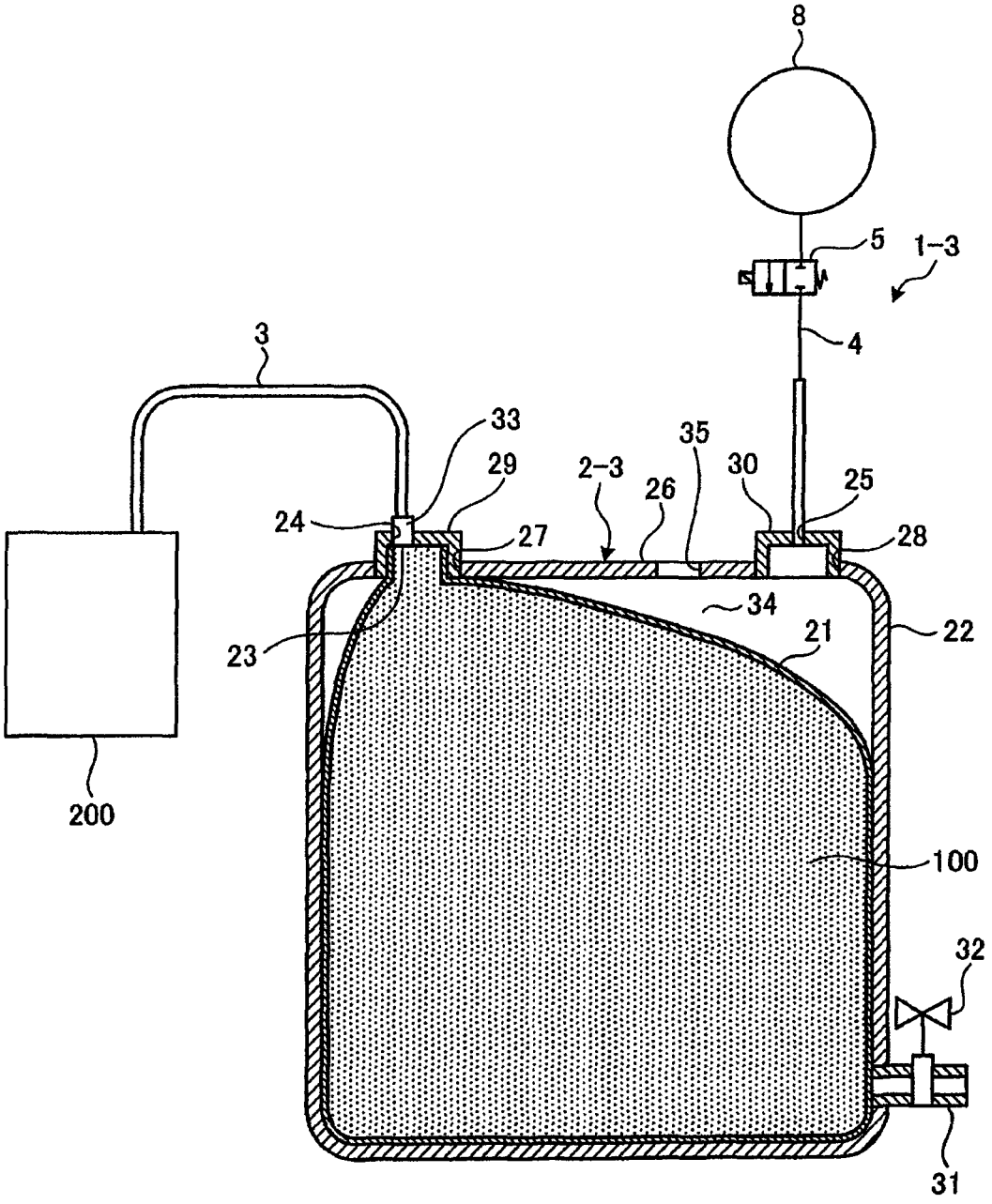
FIG. 9 is a sectional view of an essential part of a liquid supply apparatus according to Embodiment 3.
Figure 10:
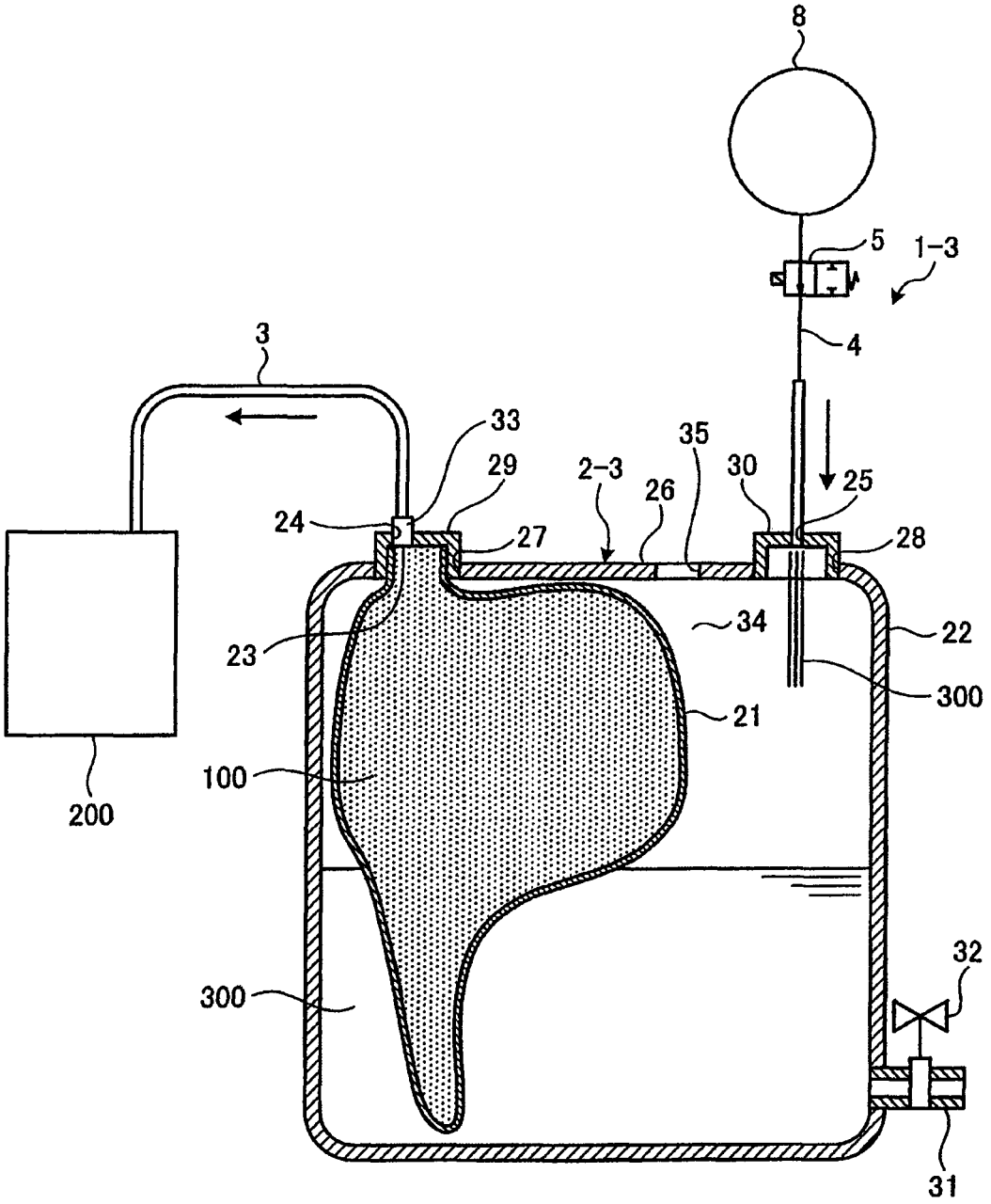
FIG. 10 is a sectional view of an essential part, depicting the liquid supply apparatus and a liquid container according to Embodiment 3 during feeding-out of a liquid.
Figure 11:
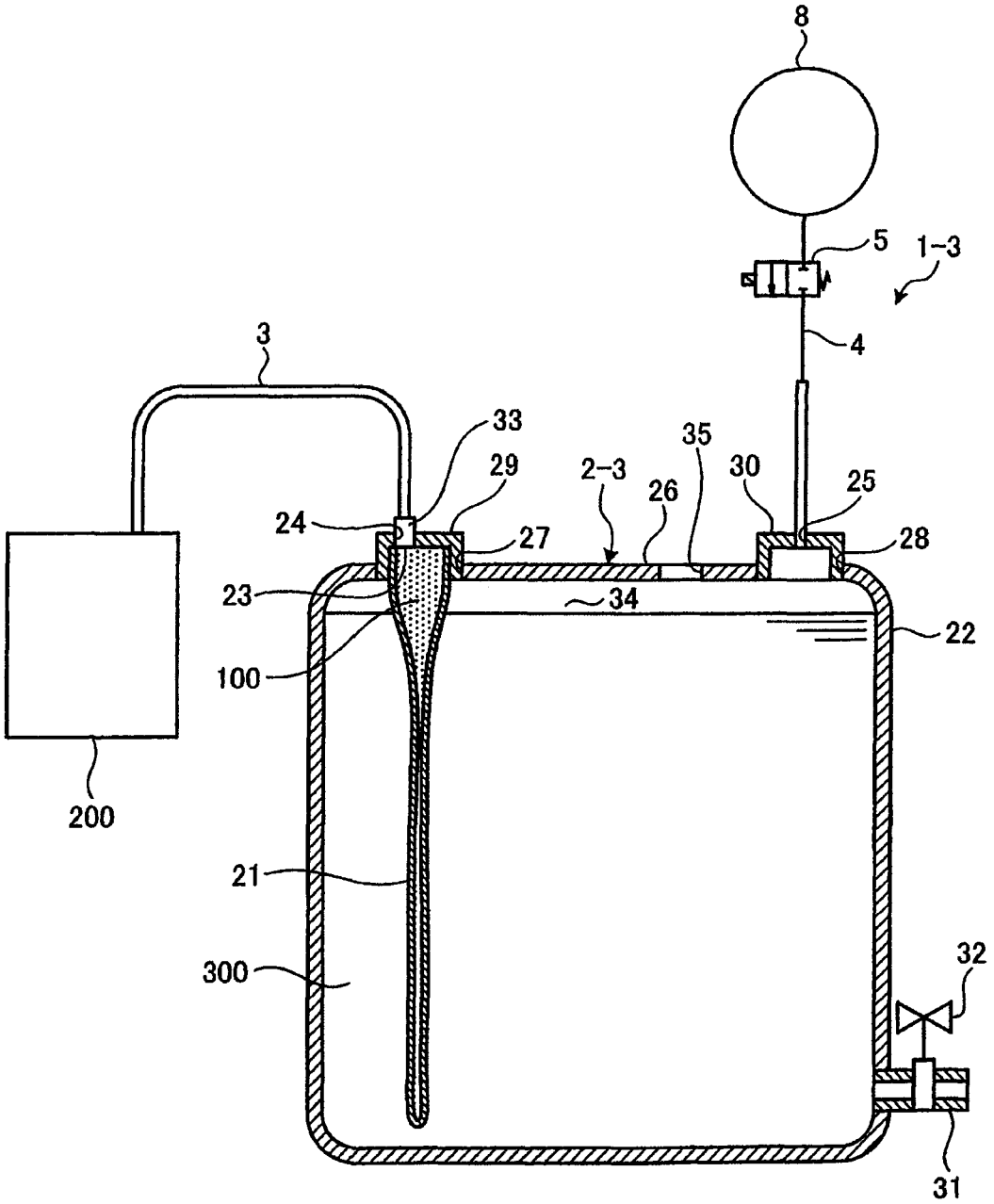
FIG. 11 is a sectional view of an essential part, depicting the liquid supply apparatus and the liquid container according to Embodiment 3 when feeding-out of the liquid is completed.
Figure 12:
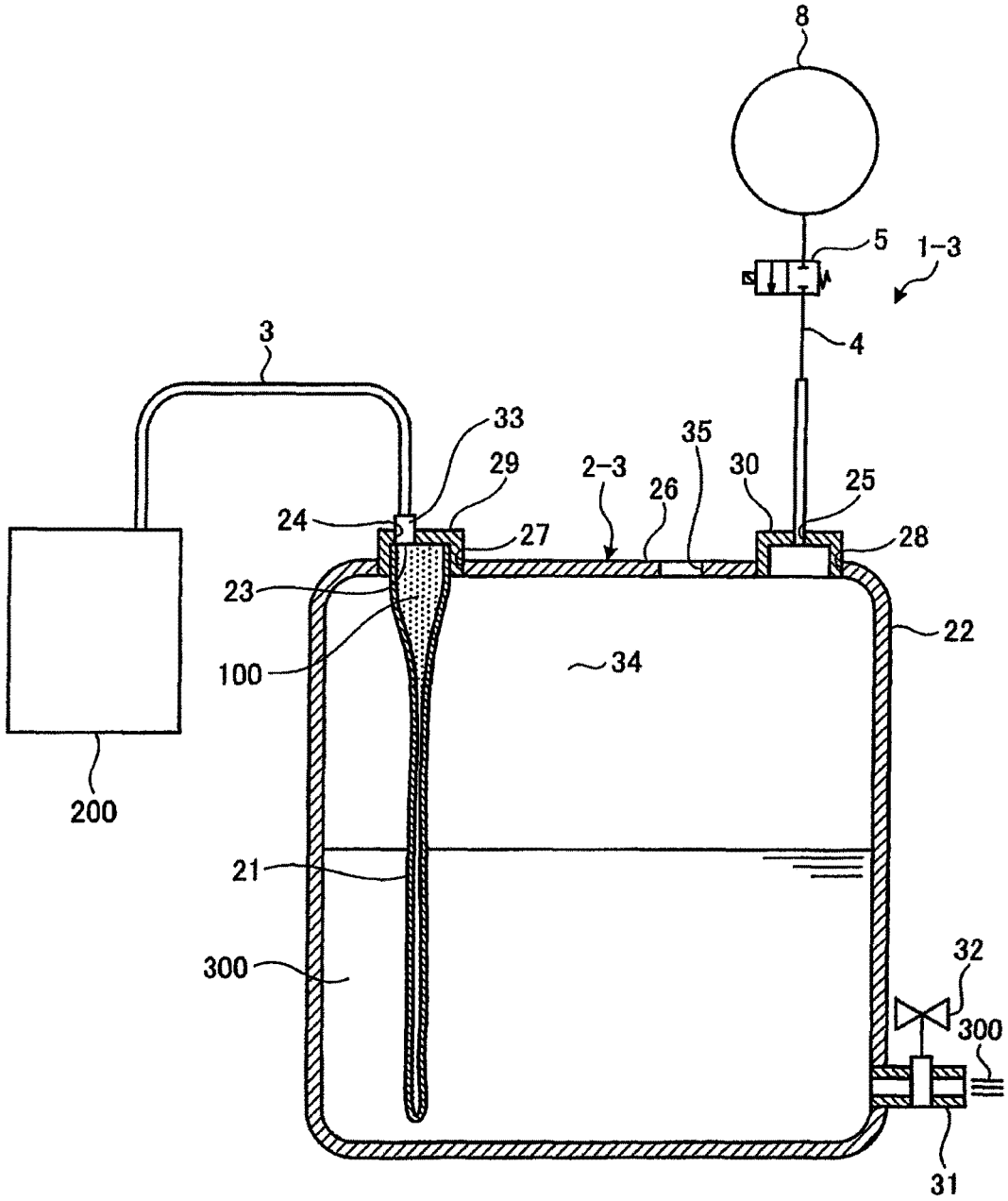
FIG. 12 is a sectional view of an essential part, depicting the liquid supply apparatus and the liquid container during feeding-out of the fluid.

A liquid container and a liquid supply apparatus according to Embodiment 3 will be described based on the drawings. FIG. 9 is a sectional view of an essential part of the liquid supply apparatus according to Embodiment 3. FIG. 10 is a sectional view of an essential part, depicting the liquid supply apparatus and the liquid container according to Embodiment 3 during feeding-out of a liquid. FIG. 11 is a sectional view of an essential part, depicting the liquid supply apparatus and the liquid container according to Embodiment 3 when the feeding-out of the liquid is completed. FIG. 12 is a sectional view of an essential part, depicting the liquid supply apparatus and the liquid container according to Embodiment 3 during the feeding-out of the fluid. In FIGS. 9 to 12, the same parts as those in Embodiment 1 above are denoted by the same reference symbols as used above, and descriptions of them will be omitted.

A liquid supply apparatus 1-3 and a liquid container 2-3 according to Embodiment 3 are configured in the same manner as in Embodiment 1, except that a gas supply passage 6 and a gas control section 7 are not provided and a gas is not supplied into an inner bag 21 (such supply is restricted), and that a through-hole 35 penetrating a wall 26 is provided. In the liquid supply apparatus 1-3 and the liquid container 2-3 according to Embodiment 3, at the time of supplying a liquid 100 to a destination 200, first, an on-off valve 32 is closed, and a fluid control section 5 opens a passage in a fluid supply passage 4, whereby a fluid 300 in a fluid supply source 8 is supplied into a space 34. As the amount of the fluid 300 supplied into the space 34 increases, the fluid 300 presses the inner bag 21 to deform the inner bag 21 in a contracting manner, as depicted in FIG. 10. In the liquid supply apparatus 1-3 and the liquid container 2-3, with the inner bag 21 pressed by the fluid 300 in the space 34 and thereby contracted, the liquid 100 in the inner bag 21 is supplied to the destination 200 through a mouth 23, a check valve 33 and a feed-out passage 3. In the liquid supply apparatus 1-3 and the liquid container 2-3, when the feeding-out of the liquid 100 in the inner bag 21 is completed, the space 34 in an outer container 22 is substantially filled up with the fluid 300, whereby portions of an inner surface of the inner bag 21 make close contact, as depicted in FIG. 11. In addition, while the through-hole 35 is provided in the wall 26 in Embodiment 3, the position where to provide the through-hole 35 in the present invention is not limited to the wall 26. The position need only be located above the liquid surface of the fluid 300 in the space 34 when the feeding-out of the liquid is completed, in the outer container 22.

In the liquid supply apparatus 1-3 and the liquid container 2-3 according to Embodiment 3, at the time of discharging the fluid 300 in the space 34 in the outer container 22 to the exterior of the outer container 22, first, the fluid control section 5 closes the passage in the fluid supply passage 4, and the on-off valve 32 is opened. Then, in the liquid supply apparatus 1-3 and the liquid container 2-3, outside air penetrates into the space 34 through the through-hole 35, so that the fluid 300 is discharged to the exterior of the outer container 22 through a discharge pipe 31, as depicted in FIG. 12. In the liquid supply apparatus 1-3 and the liquid container 2-3, when the discharge of the fluid 300 in the space 34 in the outer container 22 is completed, the fluid 300 is little left in the space 34 in the outer container 22.

The liquid supply apparatus 1-3 and the liquid container 2-3 according to Embodiment 3 include a double-structure container including the inner bag 21 and the outer container 22, and, by supplying the fluid 300 into the space 34 between the inner bag 21 and the outer container 22, the inner bag 21 is pressed and deformed so as to feed out the liquid 100; therefore, mixing of a gas into the contained liquid 100 can be restrained.

Besides, in the liquid supply apparatus 1-3 and the liquid container 2-3 according to Embodiment 3, the through-hole 35 is provided at a position of the outer container 22 which position is above the liquid surface of the fluid 300 in the space 34 when the feeding-out of the liquid is completed. When the on-off valve 32 is opened, therefore, outside air penetrates into the space 34 in the outer container 22 through the through-hole 35, so that the fluid 300 in the space 34 in the outer container 22 can be discharged easily.

Note that the present invention is not limited to the above described embodiments. In other words, the present invention can be carried out with various modifications without departing from the gist of the invention.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A liquid container comprising:

an inner bag that is made from a film-shaped member and reserves a liquid therein; and an outer container that accommodates the inner bag therein and includes a first opening communicating with a mouth of the inner bag and a second opening for supplying a fluid into a space between the inner bag and an inner wall of the outer container, wherein the inner bag with the liquid reserved therein is deformed by supplying the fluid, to thereby feed out the liquid from the inner bag to an outside, and wherein the outer container has a third opening for discharging the fluid from the space, and further wherein said third opening is provided at a lower end portion of the outer container, while said second opening is provided at an upper end portion of the outer container.

2. The liquid container according to claim 1, wherein the inner bag accommodated in the outer container is in close contact with the liquid, and a check valve for preventing returning of the liquid to be fed out is provided at the mouth of the inner bag.

3. The liquid container according to claim 1, wherein:

said outer container includes a plurality of outer surfaces, said second opening is provided on one of said outer surfaces, said third opening is provided on another one of said outer surfaces, different from said one outer surface that said second opening is provided on.

4. The liquid container according to claim 1, wherein:

said outer container includes an upper surface, a lower surface, and at least one side surface extending between said upper surface and said lower surface, said second opening is provided on said upper surface, and said third opening is provided on said side surface.

5. The liquid container according to claim 1, further comprising a through-hole provided in a wall of said outer container, wherein said through-hole is configured and arranged to allow outside air to penetrate into the space between the inner bag and the inner wall of said outer container.

6. A liquid supply apparatus configured to supply a degassed liquid to a destination by use of a liquid container, the liquid container including an inner bag that is made from a film-shaped member and reserves the degassed liquid therein, and an outer container that accommodates the inner bag therein and includes a first opening communicating with a mouth of the inner bag and a second opening for supplying a fluid into a space between the inner bag and an inner wall of the outer container, the inner bag with the liquid reserved therein being deformed by supplying the fluid, to thereby feed out the degassed liquid from the inner bag to the destination, the liquid supply apparatus comprising:

a feed-out passage for feeding out the degassed liquid from the inner bag to the destination through the first opening;

a fluid supply passage for supplying the fluid into the space in the outer container through the second opening; and a fluid control section that is disposed in the fluid supply passage and is configured to control supply of the fluid from a fluid supply source, wherein when feeding out the degassed liquid, the fluid is supplied into the space in the outer container, to press and deform the inner bag reserving the degassed liquid therein, and further comprising:

a gas supply passage for supplying a gas into the inner bag, and a gas control section configured to control supply of the gas from a gas supply source, wherein before the liquid container from which the degassed liquid has been discharged is detached from the liquid supply apparatus, the inner bag is inflated by supplying the gas to discharge the fluid collecting in the space in the outer container, thereby reducing weight of the liquid container.

7. The liquid supply apparatus according to claim 6, wherein the inner bag accommodated in the outer container is in close contact with the degassed liquid, and a check valve for preventing returning of the degassed liquid to be discharged is provided at the mouth of the inner bag.

8. The liquid supply apparatus according to claim 6, wherein the outer container has a third opening for discharging the fluid from the space.

9. The liquid supply apparatus according to claim 6, wherein the fluid is a liquid.

10. The liquid supply apparatus according to claim 6, wherein said third opening is provided at a lower end portion of the outer container, while said second opening is provided at an upper end portion of the outer container.

11. The liquid supply apparatus according to claim 6, wherein:

said outer container includes a plurality of outer surfaces, said second opening is provided on one of said outer surfaces, said third opening is provided on another one of said outer surfaces, different from said one outer surface that said second opening is provided on.

12. The liquid supply apparatus according to claim 6, wherein:

said outer container includes an upper surface, a lower surface, and at least one side surface extending between said upper surface and said lower surface, said second opening is provided on said upper surface, and said third opening is provided on said side surface.

13. The liquid supply apparatus according to claim 6, wherein said destination is a laser processing apparatus.

14. The liquid supply apparatus according to claim 13, wherein the degassed liquid is a water-soluble liquid resin.

15. The liquid supply apparatus according to claim 14, wherein the water-soluble liquid resin is a material selected from the group consisting of polyvinyl alcohol or polyvinylpyrrolidone.

16. The liquid supply apparatus according to claim 6, wherein said destination is an adhering apparatus for adhering a UV-curing liquid resin to a workpiece.

17. The liquid supply apparatus according to claim 6, wherein said fluid comprises water.

18. The liquid supply apparatus according to claim 6, wherein said gas control section comprises an on-off valve provided along said gas supply passage for opening and closing said gas supply passage.

19. The liquid supply apparatus according to claim 6, wherein said gas control section comprises a pump for feeding out the gas from said gas supply source into the inner bag.

* * * * *